United States Patent [19]

Miller

[11] Patent Number: 4,522,192

[45] Date of Patent: Jun. 11, 1985

[54] EXTRUDER MELTER APPARATUS

[75] Inventor: John H. Miller, Youngstown, Ohio

[73] Assignee: Hy-Way Heat Systems, Inc., Youngstown, Ohio

[21] Appl. No.: 573,286

[22] Filed: Jan. 23, 1984

[51] Int. Cl.[3] ..... F01C 19/45; F27B 3/06

[52] U.S. Cl. ..... 126/343.5 A; 432/210

[58] Field of Search ..... 432/13, 210; 126/343.5 R, 343.5 A

[56] References Cited

U.S. PATENT DOCUMENTS

| | | | |
|---|---|---|---|
| 1,021,781 | 4/1912 | Kingsley | 126/343.5 A |
| 2,136,242 | 11/1938 | Haupt | 126/343.5 A |
| 2,439,367 | 4/1948 | Middlestadt | 126/343.5 A |
| 2,472,594 | 6/1949 | Kuehn et al. | 126/343.5 A |
| 3,163,888 | 1/1965 | Shattuck | 126/343.5 A |
| 4,161,391 | 7/1979 | Parker | 126/343.5 A |

*Primary Examiner*—John J. Camby

*Attorney, Agent, or Firm*—Harpman & Harpman

[57] ABSTRACT

A hot oil extruder melter for melting solid blocks of coal tar enamel and the like comprises an enclosure with a plurality of interconnected elongated heating coils therein positioned to simultaneously engage, cut, and melt a coal tar enamel block positioned therein and moved therethrough.

9 Claims, 6 Drawing Figures

EXTRUDER MELTER APPARATUS

BACKGROUND OF THE INVENTION

1. Technical Field

This invention relates to the melting of solid blocks of material by exposing the same to controlled heating to provide liquefied material for various commercial uses.

2. Description of the Prior Art

Prior art devices of this type have used a variety of different heat exchanging devices to heat and liquefy different materials. See for examples U.S. Pat. Nos. 1,021,781, 2,439,367 and 4,161,391.

In U.S. Pat. No. 1,021,781, an asphalt melting wagon is disclosed which has a number of horizontally arranged heating pipes into which a block of asphalt is dropped. The heating pipes extend around the inner surface of the wagon melting the asphalt as it rests thereon.

In U.S. Pat. No. 2,439,367, a device for melting plastic is disclosed in which the material is forced through a convoluted pipe surrounded by a reservoir of hot liquid.

Finally, in U.S. Pat. No. 4,161,391, a device is shown for melting solid particles of synthetic polymer in a chamber having a circular coiled heating element.

Applicant's device utilizes a plurality of horizontally arranged elongated heating coils into which a solid block of material is forced, cut, and melted simultaneously. Hot oil is circulated through the heating coils to insure a desirable constant coil temperature and melting action.

SUMMARY OF THE INVENTION

A hot oil extruder melter for processing solid blocks of material into a usable liquid by forcing the block material into a plurality of closely spaced elongated heating coils which cut and melt the material simultaneously. The heating coils are interconnected and supplied with hot oil maintaining a constant temperature, for example 550° F.

DESCRIPTION OF THE PREFERRED EMBODIMENT

Figure 1:
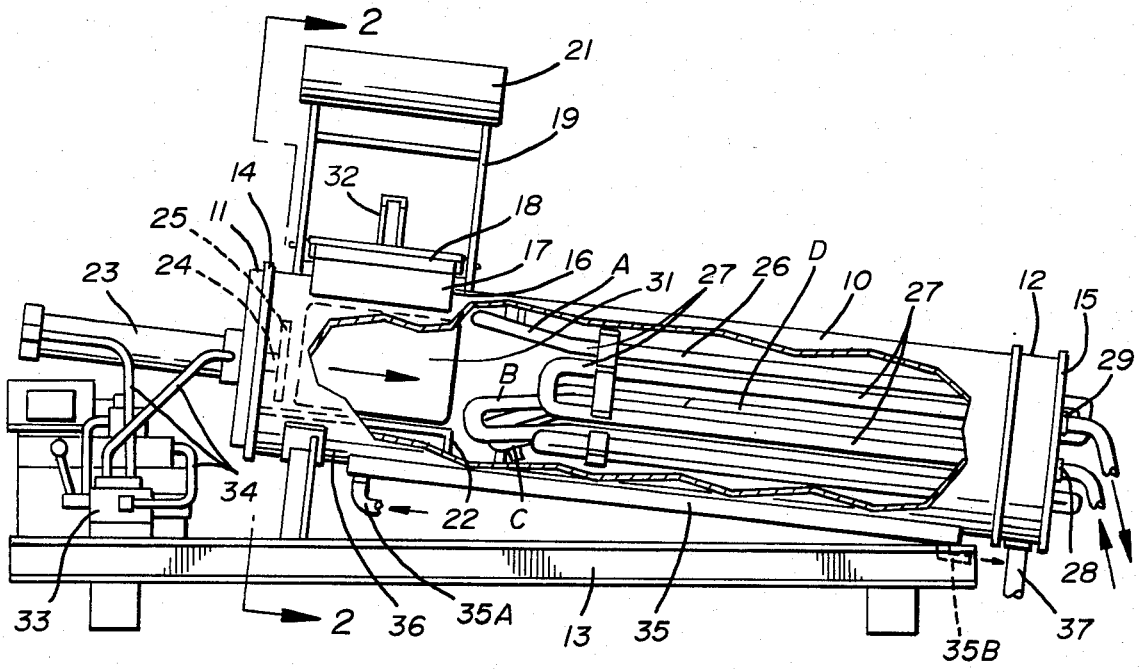
FIG. 1 is a side elevation of the hot oil extruder melter with parts broken away.
Figure 3:
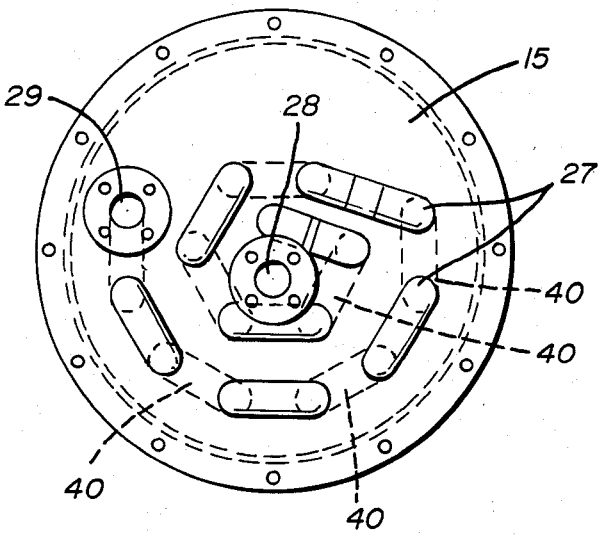
FIG. 3 is an enlarged end view of a portion of the extruder melter.
Figure 5:
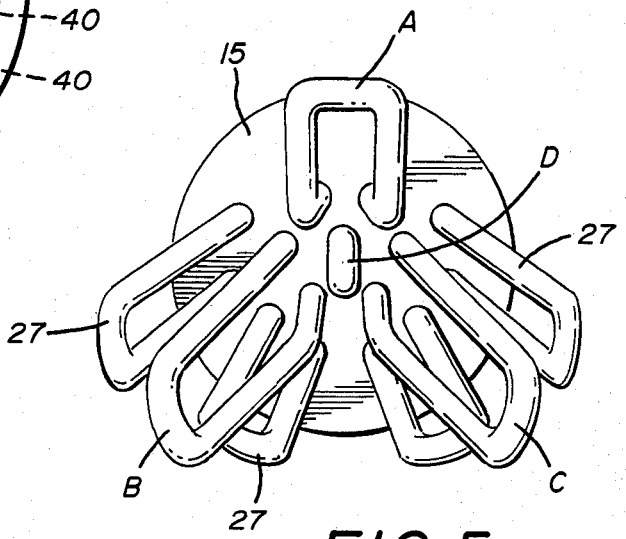
FIG. 5 is a perspective end view of the heating coils in the extruder melter.
Figure 6:
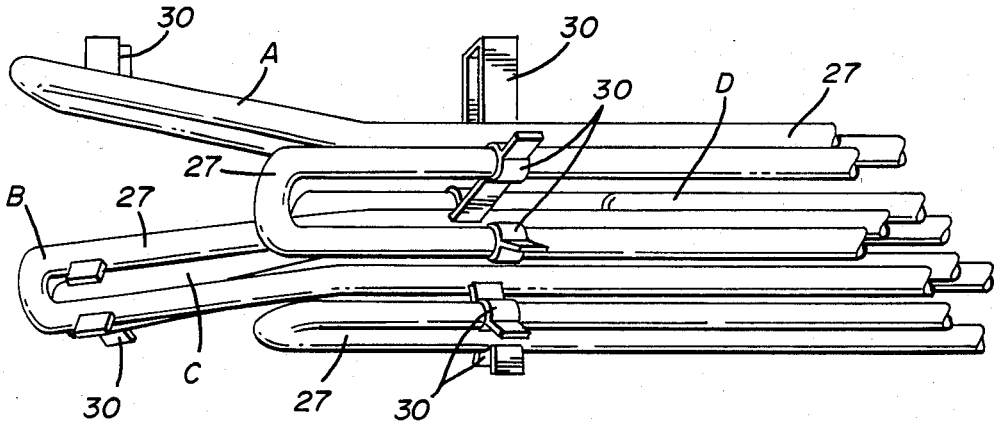
FIG. 6 is an enlarged perspective view of a portion of the heating coils seen in FIG. 5 of the drawings.

A hot oil extruder melter is illustrated in FIG. 1 of the drawings comprising a cylindrical melting tank 10 having ends 11 and 12 and is secured to and supported by a base 13. The tank 10 is positioned on the base 13 with the tank end 11 elevated providing a gentle incline of the tank 10. The tank ends 11 are formed of an apertured front plate 14 and a multiple apertured back end plate 15. A rectangular opening 16 is formed in the upper surface of the tank 10 adjacent the front plate 14 within a mounting structure 17 onto which is secured a closure 18 and pivot arm 19. The pivot arm 19 extends outwardly from the mounting structure 17 and has a material receiving area 20 on one end and an oppositely disposed counterweight 21 on the other end. The tank 10 has a material support platform 22 positioned therein which is directly under the opening 16. A hydraulic cylinder and piston assembly 23 is secured to the apertured front plate 14 and aligned with the opening therein. A piston rod 24 extends through the aperture and into the melting tank 10. A pusher plate 25 is secured to the free end of the piston rod 24 above the material supporting platform 22. A heating coil configuration 26 is positioned longitudinally within the melting tank 10 extending to and partially supported by the apertured end plate 15 as best seen in FIGS. 1, 3 and 5 of the drawings.

The heating coil configuration 26 comprises a plurality of spaced pairs of U-shaped tubes 27, three of which, A,B,C, extend outwardly beyond the rest forming a triangular guide in alignment with the support platform 22. Each of the tube pairs are interconnected as illustrated in FIG. 3 of the drawings with an inlet 28 and an outlet 29. Hot oil is supplied from a source, not shown, and pumped through the tubing 27. One pair of the tubes 27 is shorter than the rest and is positioned centrally within the heating coil configuration 26 and is indicated by D. Multiple spacers 30 are positioned around the tube pairs 27 spacing the same in relation to each other and from the inner wall of the tank 10.

Figure 2:
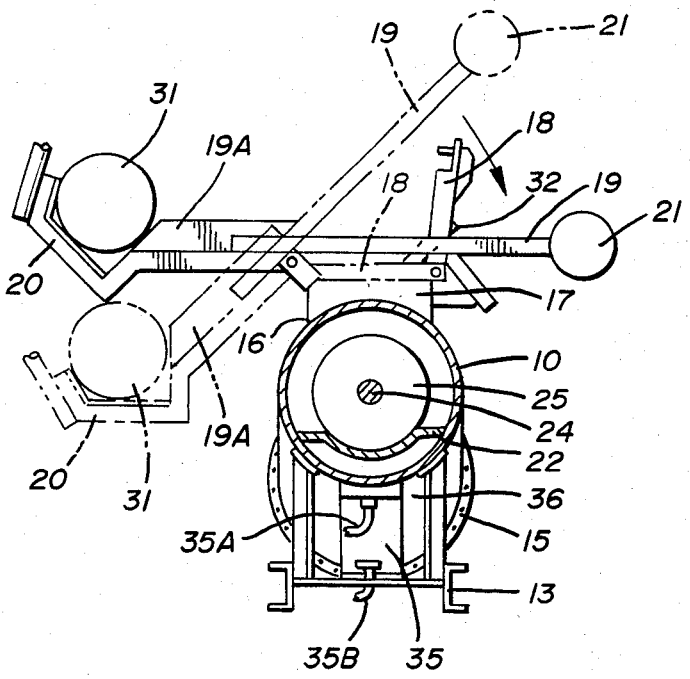
FIG. 2 is a cross section end elevation of the extruder melter of FIG. 1.

In operation, a block of material 31 is positioned on the material receiving area 20 on the pivot arm 19 as shown in dotted lines in FIG. 2 and raised to a slightly inclined position shown in solid lines in FIG. 2 of the drawings with a portion of the pivot arm 19 engaging a closure lever 32 opening the closure 18. The block of material 31 moves along the pivot arm 19 between guides 19A thereon and into the tank 10. The pivot arm 19 is returned to loading position shutting the closure 18 as it passes the same. The block of material 31 rests on the support platform 22 and is engaged by the pusher plate 25 upon activation of the cylinder and piston assembly 23 which is controlled by a control valve 33 and interconnecting supply lines 34 as is well known in the art.

The block of material 31 is pushed into and between the heating coil configuration 26 being guided by the tube pairs A,B, and C. As the block of material 31 advances, it is cut and melted by pairs of tubes 27 with the liquid product flowing downwardly to the lower end of the tank 15. The combination of outwardly extending guide tubing pairs A,B, and C and the recessed tubing pair D positions and holds the block of material 31 within the heating coil configuration 26 for maximum heating of the same.

At this point, the pusher plate 25 is returned to the tank end 11 and a second block of material 31 is dropped into the tank 10 in the same manner as hereinbefore described. The pusher plate 25 engages the second block of material 31 pushing the same forward against the first block of material 31 driving it further into the heating coil configuration 26. This process is repeated providing a constant supply of liquefied material.

Referring now to FIGS. 1 and 2 of the drawings, an elongated exterior heating jacket 35 can be seen secured to a bottom exterior surface 36 of the tank 10. The heating jacket 35 is supplied with hot oil via inlet and outlets 35A and 35B from the same source as hereinbefore described and maintains the bottom exterior surface 36 at a constant temperature so that the liquefied material produced within the tank 10 flows evenly to an outlet valve 37 adjacent the tank end 12.

Figure 4:
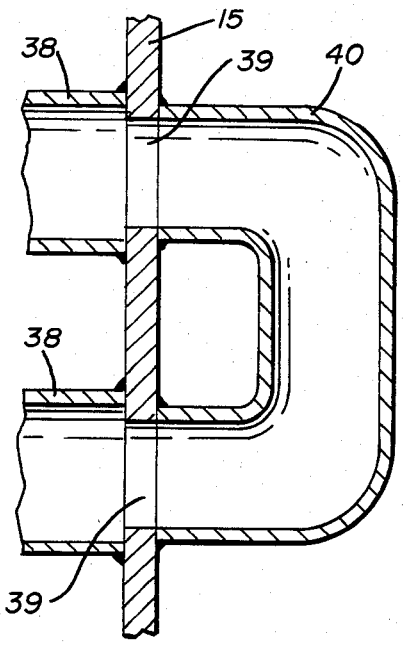
FIG. 4 is an enlarged cross sectional view of a portion of the extruder melter.

Referring to FIG. 4 of the drawings, an enlarged portion of the apertured end plate 15 can be seen with a representative pair of tubing 38 secured by welding to the apertured end plate 15 over one of the apertures 39. A tubing pair connector 40 is secured by welding to the opposite side of the apertured and plate 15 providing a continuous flow of hot oil through the tube pairs as indicated in FIG. 3 of the drawings.

It can be seen that such an arrangement transfers the force against the spaced pairs of tubes 27 represented by the tube pair 38 imparted by engagement of the block of material 31 as it is pushed thereagainst by the pusher plate 25 as hereinbefore described.

The advantages of the above-described system are evident when comparing the same against present devices now in use such as the traditional kettle-type heater wherein a typical 100 lb. block of material requires 35 to 40 minutes to melt. In the extruder melter device disclosed herein, the same 100 lb. block of material can be melted in 3 minutes.

It will thus be seen that a new and useful melting device has been illustrated and described and it will be obvious to one skilled in the art that various changes and modifications may be made therein without departing from the spirit of the invention and having thus described my invention what I claim is:

1. An extruder melter comprising an elongated tank with side and end walls, a central aperture in one of said end walls and a plurality of apertures in the other of said end walls, an access port in said tank adjacent said end wall having said central aperture, several elongated U-shaped heat transfer coils positioned in said tank longitudinally thereof and extending from said other end wall and in communication with said apertures therein and with one another and with a source of heating fluid, some of said heat transfer coils positioned in circumferentially spaced relation to one another and radially with respect to the center of said tank and at least one of said heat transfer coils positioned in the center of said tank, a ram consisting of a piston and cylinder mounted adjacent said central aperture in said one end wall of said tank, said piston movable into said tank toward and away from said heat transfer coils so as to engage and move solid meltable material positioned in said tank through said access port into and against said heat transfer coils, an outlet port in said tank for removing said meltable material when melted from said tank.

2. The extruder melter set forth in claim 1 and wherein material transfer means is positioned adjacent said access port of said tank, said material transfer means comprising a pivot arm movably attached inwardly of its ends to said tank adjacent said access port, a material receiving area extending along said pivot arm from one end thereof, a counter weight on the other end of said pivot arm, part of said pivot arm and the material receiving area thereon being movable from a first position below said access port to a second position above said access port so that material thereon will be delivered thereby into said access port and said tank.

3. The extruder melter set forth in claim 1 and wherein said tank has a material supporting platform therein positioned below said access port and below said ram.

4. The extruder melter set forth in claim 1 and wherein some of said heat transfer coils positioned in circumferentially spaced relation to one another and radially with respect to the axis of said tank extend outwardly beyond the rest of said heat transfer coils and define a triangular guide around said heat transfer coil positioned on the axis of said tank.

5. The extruder melter set forth in claim 1 and wherein said tank has an elongated closed jacket on its lower surface and means on the opposite ends of said jacket for introducing heated fluid thereinto and removing the same therefrom.

6. The extruder melter set forth in claim 1 and wherein said U-shaped heat transfer coils are of a diameter greater than that of the apertures in said other end of said tank and the ends of said heat transfer coils are welded to said other end of said tank.

7. The extruder melter set forth in claim 1 and wherein a support structure is positioned in said tank and engaged on said heat transfer coils so as to support the same in spaced relation to one another and with respect to the side wall of said tank.

8. The extruder melter set forth in claim 1 and wherein said elongated tank is positioned on and supported by a base with the end of the tank having the central aperture and the piston movable therethrough being elevated with respect to the base and with respect to said other end of said tank and wherein said outlet port is located in said other end of said tank.

9. The extruder melter set forth in claim 1 and wherein U-shaped tubular connecting members are secured to said other end of said tank on the exterior thereof in communication with said apertures therein and with said pairs of U-shaped heat transfer coils so as to circulate heating fluid therethrough.

* * * * *